US010197071B2

(12) United States Patent
Furet et al.

(10) Patent No.: US 10,197,071 B2
(45) Date of Patent: Feb. 5, 2019

(54) CONTROLLABLE CONSTRICTION DEVICE FOR THE THROAT OF A VENTURI CHANNEL FOR INTRODUCING A LIQUID ADDITIVE INTO A STREAM OF MAIN LIQUID

(71) Applicant: DOSATRON INTERNATIONAL, Tresses (FR)

(72) Inventors: Sebastien Furet, Bordeaux (FR); Sandrine Lambinet, Sadirac (FR); Philippe Duquennoy, Camarsac (FR); Manal Badii, Merignac (FR)

(73) Assignee: DOSATRON INTERNATIONAL, Tresses (FR)

( * ) Notice: Subject to any disclaimer, the term of this patent is extended or adjusted under 35 U.S.C. 154(b) by 640 days.

(21) Appl. No.: 14/761,555

(22) PCT Filed: Dec. 17, 2013

(86) PCT No.: PCT/IB2013/061042
§ 371 (c)(1),
(2) Date: Jul. 16, 2015

(87) PCT Pub. No.: WO2014/111770
PCT Pub. Date: Jul. 24, 2014

(65) Prior Publication Data

US 2015/0361994 A1 Dec. 17, 2015

(30) Foreign Application Priority Data

Jan. 17, 2013 (FR) ..... 13 50397

(51) Int. Cl.
*B01F 5/04* (2006.01)
*F04B 9/105* (2006.01)
(Continued)

(52) U.S. Cl.
CPC ..... *F04F 5/48* (2013.01); *B01F 5/0421* (2013.01); *B01F 5/0428* (2013.01);
(Continued)

(58) Field of Classification Search
CPC ..... F04F 5/48; F04F 5/12; F04F 5/463; F04F 5/10; F04F 5/461; B01F 5/0428;
(Continued)

(56) References Cited

U.S. PATENT DOCUMENTS 3,930,756 A * 1/1976 Bruggeman ..... F04B 1/00 137/529
6,170,978 B1 * 1/2001 Short ..... B01F 5/0413 137/893
(Continued)

FOREIGN PATENT DOCUMENTS

EP 1 151 196 B1 7/2003
EP 1 773 479 A1 4/2007
(Continued)

OTHER PUBLICATIONS

International Search Report, dated Apr. 9, 2014, from corresponding PCT application.

*Primary Examiner* — Charles Cooley
(74) *Attorney, Agent, or Firm* — Young & Thompson

(57) ABSTRACT

Metering device for introducing a liquid additive into a main liquid flowing along a pipe, includes a pump for withdrawing additive from a container and metering it, this pump including a first inlet for receiving a flow of main liquid which drives the pump, a second inlet for picking up additive and an outlet for the resulting mixture; a Venturi installed in the pipe, and connected in parallel with the pump, the first pump inlet connected by a first line to the Venturi inlet while the outlet connected by a second line to the Venturi throat; a first element for varying the restriction
(Continued)

at the Venturi neck, and a second element sensitive to the pressure drop across the pump for controlling the first element to reduce the bore section when the pressure drop across the pump increases, and increase the bore section when the pressure drop across the pump decreases.

19 Claims, 5 Drawing Sheets

(51) Int. Cl.

| | |
|---|---|
| ***F04B 23/10*** | (2006.01) |
| ***F04B 13/02*** | (2006.01) |
| ***F04F 5/48*** | (2006.01) |
| ***F04F 5/46*** | (2006.01) |
| ***F04F 5/12*** | (2006.01) |
| ***F04F 5/10*** | (2006.01) |

(52) U.S. Cl.
CPC ..... *B01F 5/0486* (2013.01); *B01F 5/0496* (2013.01); *F04B 9/1053* (2013.01); *F04B 13/02* (2013.01); *F04B 23/106* (2013.01); *F04F 5/10* (2013.01); *F04F 5/12* (2013.01); *F04F 5/461* (2013.01); *F04F 5/463* (2013.01); *B01F 2005/0435* (2013.01)

(58) Field of Classification Search
CPC ..... B01F 5/0496; B01F 5/0418; B01F 5/042; B01F 5/0421; B01F 5/0423; B01F 5/0488; B01F 5/0486; B01F 2005/0435; F04B 13/02; F04B 23/106; F04B 9/1053
See application file for complete search history.

(56) References Cited

U.S. PATENT DOCUMENTS

| | | | | |
|---|---|---|---|---|
| 6,293,294 | B1 * | 9/2001 | Loeb | B01F 5/0405 137/1 |
| 6,684,753 | B1 | 2/2004 | Urrutia | |
| 2007/0227961 | A1 * | 10/2007 | Barras | B01F 5/0413 210/258 |
| 2010/0269685 | A1 * | 10/2010 | Darbois | F03C 1/26 91/415 |
| 2010/0282072 | A1 * | 11/2010 | Darbois | F03C 1/26 92/130 R |
| 2013/0233421 | A1 * | 9/2013 | Furet | F04B 9/105 137/565.11 |
| 2015/0361994 | A1 * | 12/2015 | Furet | B01F 5/0428 417/192 |
| 2016/0325244 | A1 * | 11/2016 | Lambinet | B01F 5/0495 |

FOREIGN PATENT DOCUMENTS

| | | | | |
|---|---|---|---|---|
| GB | 976578 | A * | 11/1964 | A01C 23/042 |
| WO | WO-03020391 | A1 * | 3/2003 | B01F 5/0413 |
| WO | 2009/095704 | A2 | 8/2009 | |
| WO | 2012/063184 | A1 | 5/2012 | |

* cited by examiner

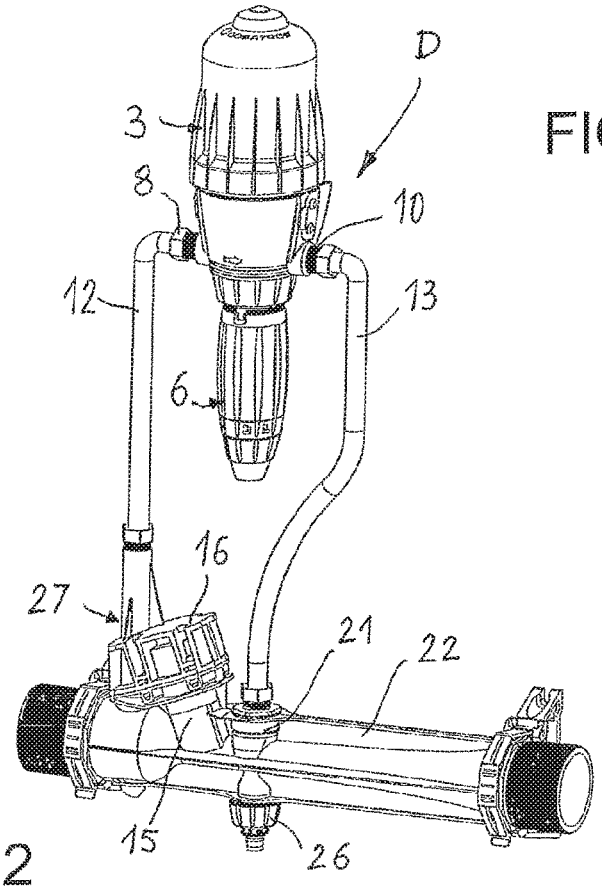
FIG.3
FIG.2
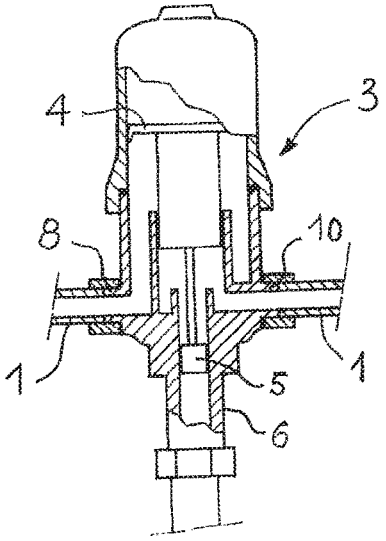
FIG.6
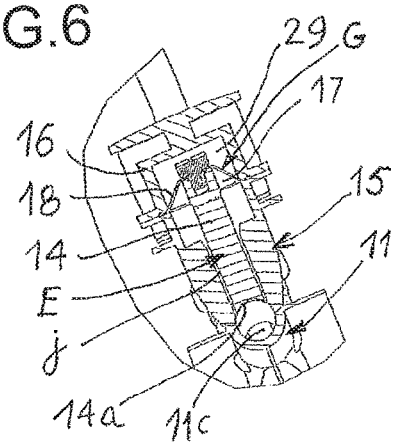

FIG.7
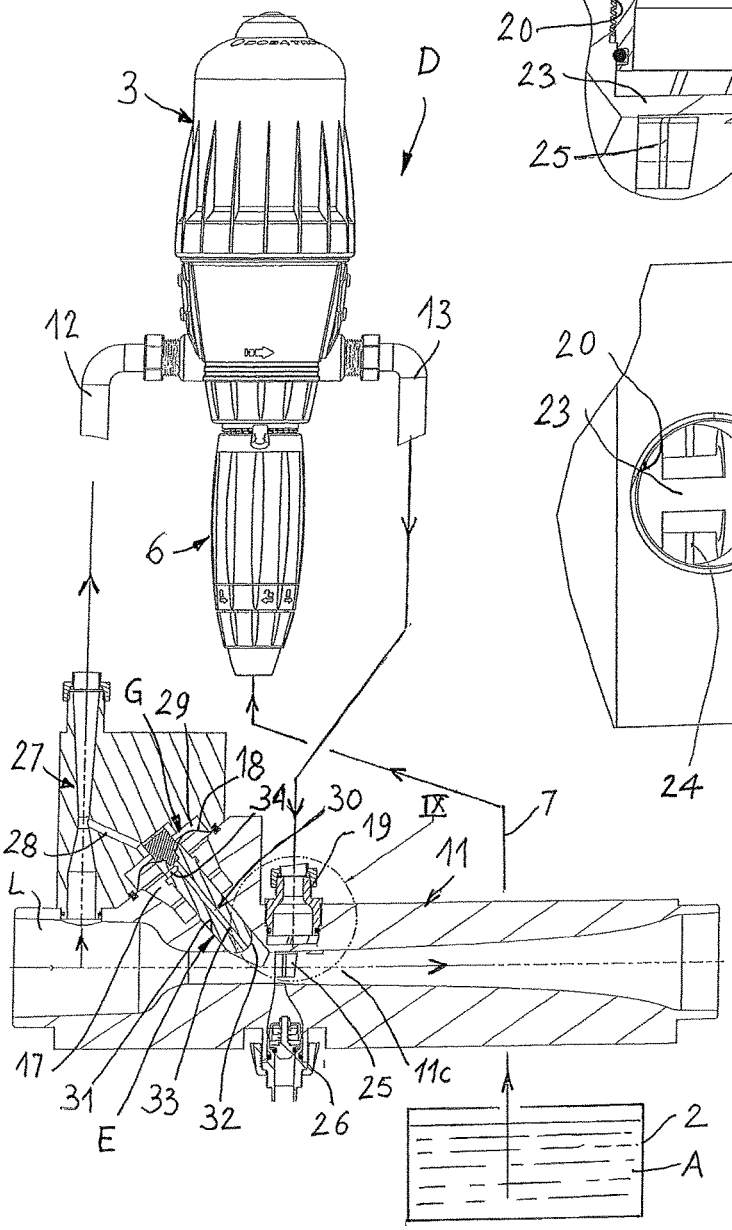
FIG.9
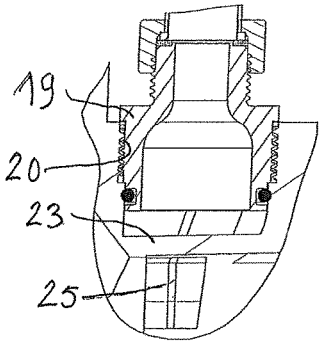
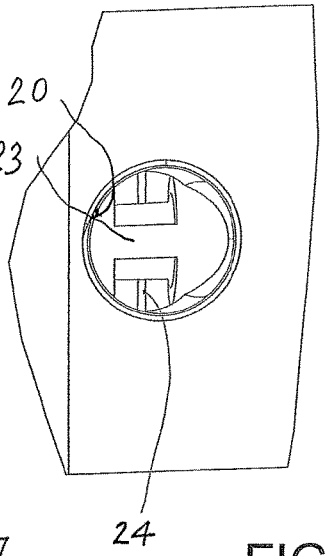
FIG.10

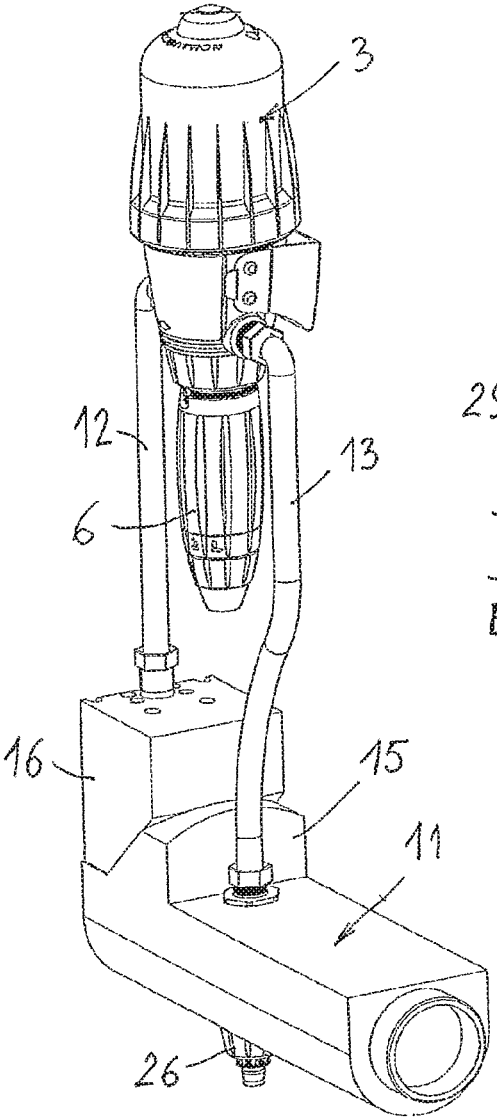
FIG.8
FIG.11
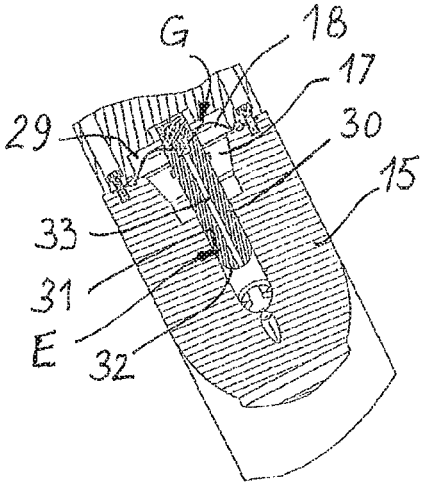

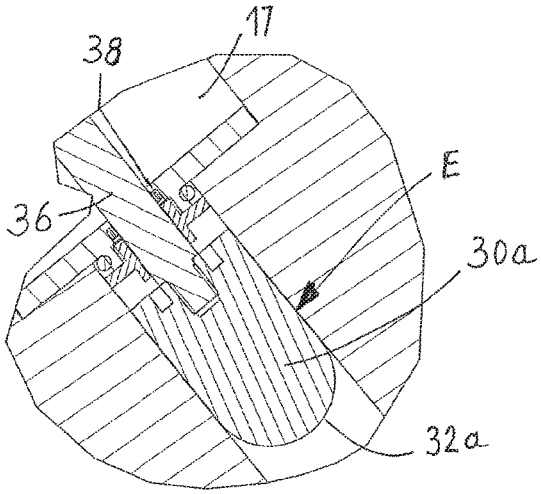
FIG.14
FIG.13
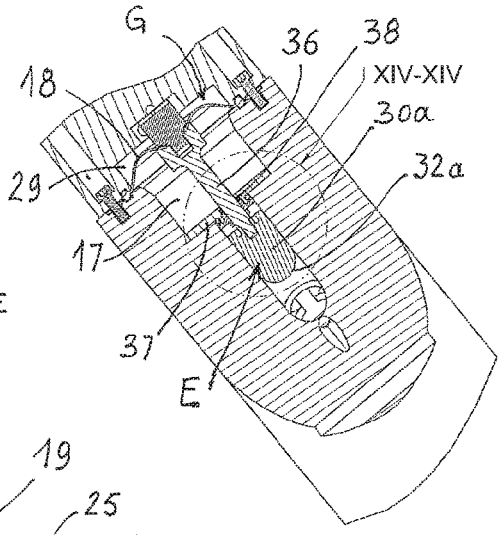
FIG.12
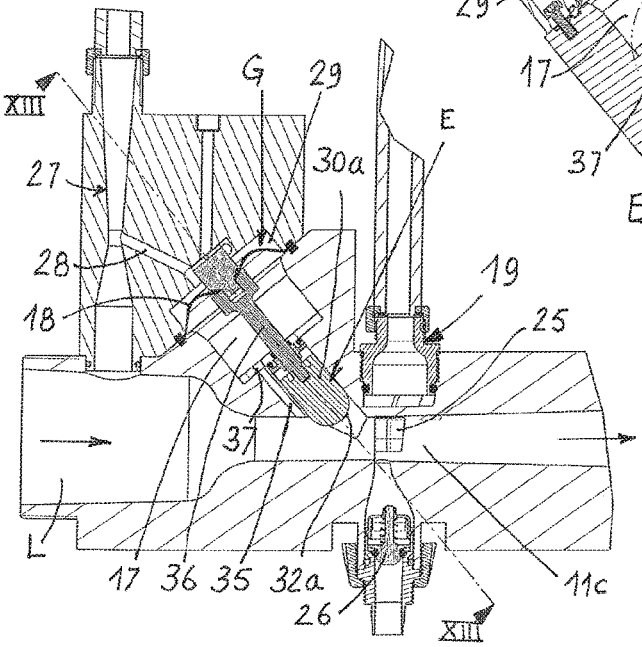

CONTROLLABLE CONSTRICTION DEVICE FOR THE THROAT OF A VENTURI CHANNEL FOR INTRODUCING A LIQUID ADDITIVE INTO A STREAM OF MAIN LIQUID

FIELD OF THE INVENTION

The invention relates to a metering device for introducing a liquid additive into a stream of main liquid flowing in a pipe, the device being of the type comprising a reciprocating differential piston pump for taking up the additive in a container and metering it, this pump comprising a first inlet for receiving a main liquid flow that drives the pump, a second inlet for taking up the additive and an outlet for mixing the additive and the liquid, the device comprising a venturi arranged in the pipe, the pump being connected in parallel with the venturi, the first inlet of the pump being connected via a first line to the inlet of the venturi while the outlet of the pump is connected via a second line to the throat of the venturi.

DESCRIPTION OF THE RELATED ART

A metering device of this kind is known from the applicant's EP 1773479, by means of which it is possible to deal with high main liquid flow rates using compact pumps and to increase the permitted range of metering. The differential piston pumps used in these metering devices are known per se, in particular from EP 1151196 or U.S. Pat. No. 6,684,753.

In a metering pump, the differential piston moves in reciprocating fashion and drives a plunger piston to take up the additive to be metered during an upward stroke and to inject this additive into the main liquid or motive liquid during a downward stroke. The pressure drop between the first inlet of the pump and the outlet varies depending on the operating phases of the pump. For good energy efficiency of the pump, the venturi must be provided in order to create a pressure drop, between its inlet and the throat, which is essentially equal to the pressure drop in the pump.

For relatively small additive metering, in particular below 1% of additive in the main liquid, in particular when a diversion line, with a factor of 10, is put in place with metering pumps metering to 0.3% in the diverted flow to obtain 0.03% in the total flow, the metering devices of the type defined above are satisfactory since the differences in pressure drop between the upward and downward strokes of the differential piston are not too large. The performance of the metering device remains acceptable since the pressure drop between the throat of the venturi and the inlet of the latter is not that different from the pressure drop in the pump during the upward and downward strokes of the differential piston.

When the metering of the liquid additive increases, in particular above 2% in the deviated flow to give 0.2% in the total flow, or 10% in the deviated flow to give 1% in the total flow, the difference in pressure drop between the upward and downward phases of the differential piston increases. This phenomenon is more apparent with higher pressure in the metering system and with greater metering of the metering device in the diversion line, since the pressure drop during the upward stroke has to compensate for the pressure applied to the metering piston which serves to meter the additive. This results in a reduction in precision, or in it being impossible to bring about the pressure drop necessary for the operation of the metering pump over a large range of flow rates, typically with a ratio of 6 to 10 between the minimum and maximum main flow rates.

BRIEF SUMMARY OF THE INVENTION

Most importantly, the invention has the aim of proposing a metering device of the type mentioned above, which partially or completely avoids the abovementioned drawbacks and which makes it possible to optimize operation, in particular in the event that the metering of additive is relatively high, in particular above 0.2% in the main liquid.

According to the invention, a metering device of the type defined above is characterized in that it comprises:

- a means for varying the constriction of the throat of the venturi,
- and a means sensitive to the pressure drop in the pump, which means is able to control the means for constricting the throat of the venturi to reduce the passage cross section when the pressure drop in the pump increases, and to increase the passage cross section when the pressure drop in the pump decreases.

Advantageously, the means sensitive to the pressure drop in the pump consists of a means for comparing the pressure at the throat of the venturi with the pressure at the throat of a second venturi arranged on the first line leading to the inlet of the pump.

The effectiveness of the metering device according to the invention is improved by better matching the total pressure drop between the inlet and the outlet of the pump and the pressure drop at the throat of the venturi.

The means for varying the constriction of the throat of the venturi preferably comprises a member which is mounted so as to be able to slide in a direction inclined with respect to the geometric axis of the venturi.

The means for comparing the pressures at the throats of the two venturis may comprise a movable separating means separating two chambers connected respectively to the throat of one of the two venturis, the constriction member being connected to this movable separating means such that a pressure increase at the throat of the second venturi relative to the pressure at the throat of the first venturi causes an increase in the constriction of the throat of the first venturi, and vice-versa.

Advantageously, the movable separating means comprises a membrane.

The sliding member may consist of a vane. This vane may be mounted so as to be able to slide, with sufficient gap, in a guide of the body of the venturi such that the pressure at the throat is transmitted to the chamber located on the side of the throat.

According to another possibility, the constriction member consists of a cylindrical rod. That end of the cylindrical rod which is oriented toward the throat may be essentially hemispherical.

The cylindrical rod may be attached to the end of a smaller-diameter rod which passes in a sealed manner through a plate closing a chamber connected to the throat of the venturi.

Advantageously, a duct is located upstream of the constriction member to provide a pressure tapping by means of which it is possible to measure the flow rate at the throat of the venturi.

According to another possibility, the cylindrical rod comprises a longitudinal duct which opens at its end on the side of the throat of the venturi and is connected, at its other end, to a chamber located on the side of the throat of the venturi.

The outlet line of the pump is connected to the throat of the venturi via at least one opening which is lateral with respect to the attachment of the line on the body of the venturi.

Advantageously, the venturi and the pump form an assembly, with connection means provided at the inlet and the outlet of the venturi such that it can be inserted into and connected to two sections of the pipe.

BRIEF DESCRIPTION OF THE DRAWINGS

Apart from the abovementioned provisions, the invention consists of a certain number of other provisions which will be dealt with more specifically hereinbelow with reference to exemplary embodiments described with reference to the appended drawings but which are in no way limiting. In these drawings:

FIG. 2 is a simplified schematic view, with partial cutaway, of a differential piston pump of the same type as that used in the device according to the invention.

FIG. 3 is a smaller-scale perspective view of the metering device of FIG. 1.

FIG. 6 is a larger-scale section view along a plane orthogonal to the plane of FIG. 1, and passing through the median plane of the constriction means consisting of a vane.

FIG. 7 shows, similarly to FIG. 1, a variant embodiment of the metering device according to the invention, with the constriction member consisting of a cylindrical rod.

FIG. 8 is a smaller-scale perspective view of the device of FIG. 7.

FIG. 9 shows, enlarged, the detail IX of FIG. 7.

FIG. 10 is a plan view with respect to FIG. 9, with the connection removed.

FIG. 11 is a larger-scale section through the rod, similar to the section of FIG. 6.

FIG. 12 shows, in vertical longitudinal section, a variant of the dosing device of FIG. 7, with a solid cylindrical rod as constriction member.

FIG. 13 is a larger-scale section along the line XIII-XIII of FIG. 12, and FIG. 14 is an enlarged detail of FIG. 13.

DETAILED DESCRIPTION OF THE PREFERRED EMBODIMENTS

Figure 1:
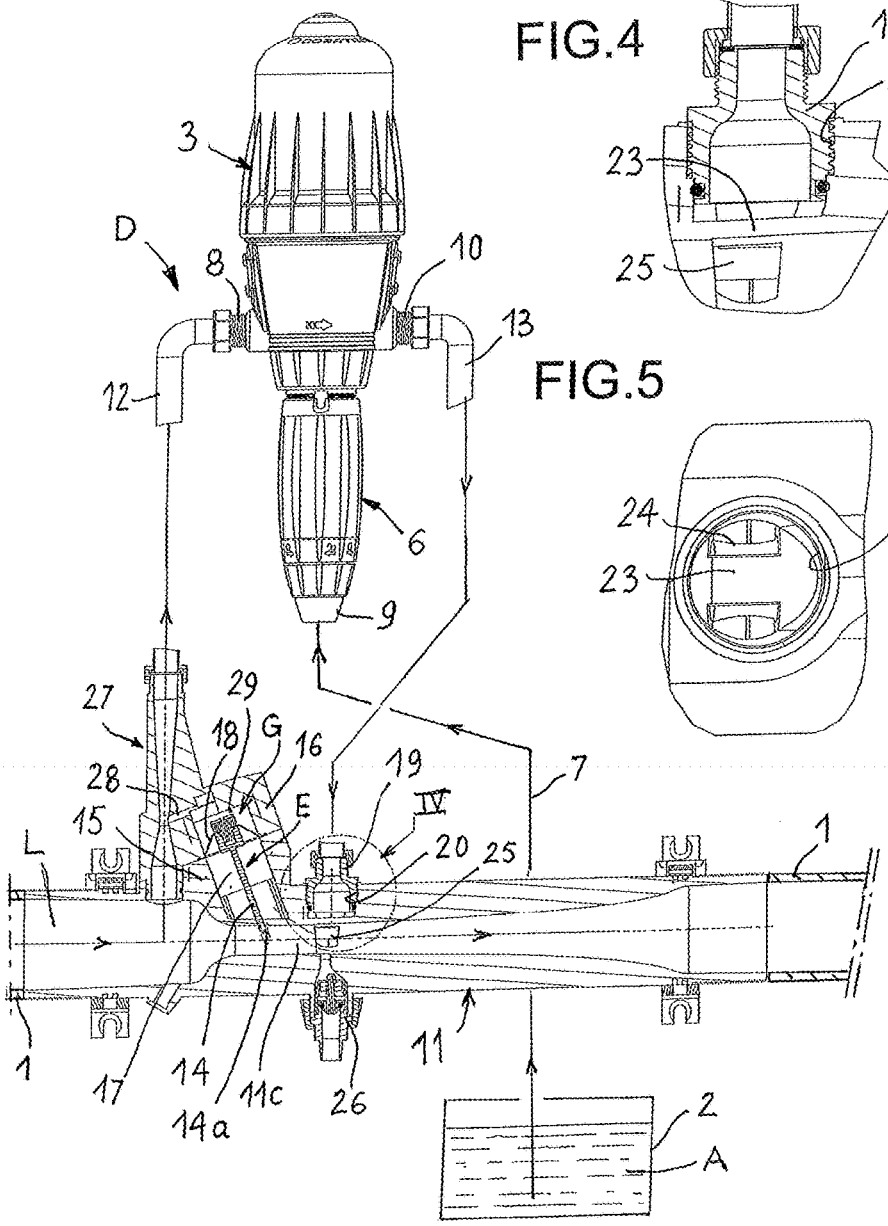
FIG. 1 is a vertical longitudinal section through a metering device according to the invention, with outer parts and parts represented schematically.
Figure 4:
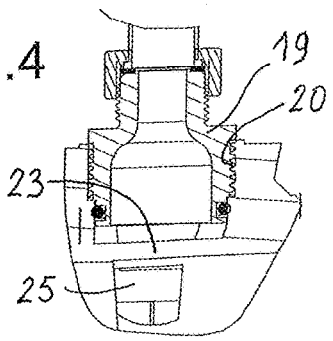
FIG. 4 is a larger-scale view of the detail IV of FIG. 1, showing a connection in an opening of the body of the venturi.
Figure 5:
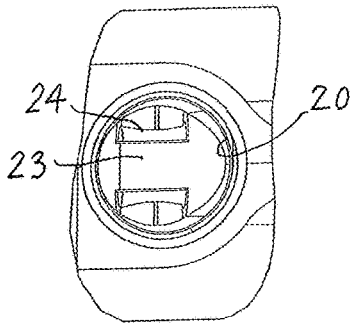
FIG. 5 is a plan view with respect to FIG. 4, with the connection removed.

The drawings, in particular FIGS. 1 to 3, show a metering device D for introducing a liquid additive A into a stream of main liquid L flowing in a pipe 1 shown schematically. The main liquid is generally water but the device D may be suitable for any type of liquid. The liquid additive A is contained in a container 2, which is shown schematically.

The device D comprises a pump 3 arranged with its axis vertical. The pump 3 is of a known type, in particular made and sold by the applicant. An example of such pumps is described in EP 1151196 or U.S. Pat. No. 6,684,753. As shown schematically in FIG. 2, the pump 3 comprises a reciprocating differential piston 4 which drives a smaller-diameter piston 5 for taking up the additive in the container 2 and metering it. The plunger piston 5 slides in a cylindrical chamber of an auxiliary pump 6 connected via a feed tube 7 to the container 2. The tube 7 is immersed in the additive A to be taken up.

Conventional valve means, or similar, are provided to control the reciprocating motion of the differential piston 4. These known means are neither shown nor described.

The pump 3 comprises a first inlet 8 for receiving a main liquid flow that drives the differential piston 4. The pump 3 comprises a second inlet 9 located in the lower portion of the body of the auxiliary pump 6 for taking up the additive A, and an outlet 10 for mixing, in a metered manner, the additive A and the main liquid L.

The device D comprises a venturi 11 arranged in the pipe 1. The first inlet 8 of the pump is connected via a first line 12 to the inlet of the venturi while the outlet 10 of the pump is connected via a second line 13 to the throat of the venturi. Thus, the pump 3 is connected in parallel with the venturi.

The device D according to the invention comprises a means for varying the constriction E of the throat of the venturi 11, and a means G sensitive to the pressure drop in the pump 3 for controlling the means for constricting E the throat of the venturi.

The means for varying the constriction E, as shown in the embodiment of FIGS. 1-6, comprises a vane 14 which is mounted so as to be able to slide in a direction inclined, from upstream to downstream, with respect to the geometric axis of the venturi 11. As shown in FIG. 1, the upstream-facing angle of inclination formed between the vane 14 and the geometric axis of the venturi is approximately 70°.

The vane 14 is arranged in an essentially cylindrical base 15, projecting from the body of the venturi 11, this base being topped with a cover 16. The base and the cover define a cylindrical recess whose geometric axis is inclined with respect to the geometric axis of the venturi. The vane 14 is located in a plane orthogonal to the vertical plane passing through the geometric axis of the venturi 11. The vane 14 passes through a slot provided in the wall of the throat of the venturi and its lower end 14*a* can project into the throat 11*c* of the venturi. The end 14*a*, as shown in FIG. 6, is in the form of a concave arc of a circle. The vane 14 slides in a guide of the body of the venturi with sufficient gap j (FIG. 6) for the pressure at the throat 11*c* of the venturi to be transmitted to a chamber 17 located on the side of the throat and bounded by a deformable flexible membrane 18 whose periphery is clamped in a sealed manner between the base 15 and the cover 16, which latter two are assembled in a dismantlable manner by means of screws or the like.

As is conventional, the venturi 11 comprises a convergent portion located upstream of the throat 11*c* and a divergent portion downstream of the throat. "Throat 11*c*" refers to a region of the venturi whose axial extent may be rather long and whose diameter is smaller than those of the inlet and the outlet.

The outlet line 13 of the pump is connected via a connector 19 which is screwed, in a sealed manner and with a seal, into a tapped hole 20 provided on the periphery of the body of the venturi. The geometric axis of the hole 20 is located in a plane orthogonal to the plane of the vane 14 and passing through the geometric axis of the venturi. As shown in FIG. 3, the body of the venturi comprises ribs 22 which are offset by an angle of 90° and the tapped hole 20 is made in a cylindrical core 21 of geometric axis orthogonal to that of the venturi and projecting on either side of a rib 22 to which it is connected. The hole 20 does not open directly into the throat of the venturi, from which it is separated in the direction of the geometric axis of the hole 20 by a bottom wall 23. Transversely on either side of this wall 23 there is provided a channel 24 which opens into the throat of the venturi through a lateral lumen 25 whose angular position is offset by approximately 90° with respect to the tapped hole 20 for connecting the outlet line 13.

This arrangement with at least one and preferably two lateral lumens 25 for injecting the mixture of liquid and additive into the flow of main liquid, close to the throat of the venturi, makes it possible to reduce turbulence.

A valve 26 for breaking the vacuum is diametrically opposite the connector 19 and is in communication with the throat of the venturi. The valve 26, which may be connected to a drain in case of a leak, opens in the event of a drop in pressure downstream, in order to avoid siphoning the vat of product.

The means G sensitive to the pressure drop in the pump 3 comprises a means for comparing the pressure at the throat of the venturi 11 with the pressure at the throat of a second venturi 27 arranged on the first line 12 leading to the inlet 8 of the pump. The means G advantageously consists of the membrane 18, as shown in the exemplary embodiment of the drawings.

The second venturi 27 is provided in a block which is secured to the cover 16. The geometric axis of the venturi 27 is orthogonal to the geometric axis of the first venturi 11. The inlet of the convergent portion of the second venturi 27 consists of an opening which opens into the inlet of the venturi 11. The throat of the second venturi 27 is connected, via a transverse duct 28, to a chamber 29 provided in the cover 16 and located on the side of the membrane 18 remote from the first venturi 11. The divergent portion of the venturi 27 is oriented toward the pump 3 and is connected to the line 12.

That being said, the metering device according to the invention operates as follows.

A flow of main liquid L flows in the pipe 1 at a static pressure of, in general, 1 to 6 bar. At the throat of the venturi 11, the flow speed of the fluid increases and its static pressure drops. The difference in pressure between the inlet of the venturi 11 and the throat makes it possible to operate the pump 3 and to actuate the differential piston using a small portion of the main flow, diverted via the second venturi 27 and the line 12.

The auxiliary pump 6, driven by the reciprocating motion of the differential piston 4, takes up metered quantities of additive A in the container 2 and the metered mixture is injected, at the throat of the venturi, via the line 13 through the lumens 25.

During the upward stroke of the differential piston 4 and of the plunger piston 5, the pressure drop between the inlet 8 and the outlet 10 of the pump 3 is greater than during the downward stroke, and the pressure at the throat of the second venturi 27 increases with respect to that prevailing at the throat of the first venturi 11.

In these conditions, the pressure in the chamber 29 rises above that prevailing in the chamber 17 and the membrane 18 deforms to allow the vane 14 to slide and to further enter the throat of the venturi 11. This produces an increase in the pressure drop between the inlet and the throat of the venturi 11, which makes it possible to equalize the pressure drop at the throat of the venturi 11 and the pressure drop between the inlet 8 and the outlet 10 of the pump 3, or at the very least to minimize the difference between these pressure drops, which helps to improve the effectiveness and the operational efficiency of the pump.

During the downward stroke of the differential piston 4 and of the plunger piston 5, the pressure drop between the inlet and the outlet of the pump 3 is smaller, such that the vane 14 retreats into the chamber 17 and reduces the constriction of the throat of the venturi 11, and thus the pressure drop between the convergent portion and the throat of the venturi 11.

Thus, the vane 14 and the membrane 18 will oscillate at the speed of the differential piston 4 to better equalize the pressure drop at the throat of the venturi 11 and the total pressure drop in the pump 3.

The effectiveness of the metering device is maintained when the metered quantities are relatively high, in particular greater than 0.2% of additive A in the main flow, and up to 1% in the main flow.

The operating range of the device according to the invention is broadened. Startup at low flow rates is made more reliable, which makes it possible to start with a low flow rate (in particular, the minimum flow rate is 6 to 10 times smaller than the maximum flow rate) and to increase this flow rate after startup, while retaining precise metering and good operational effectiveness.

FIGS. 7-11 show a variant embodiment of the metering device D. Those elements of this device which are identical or similar to elements already described in the context of the preceding embodiment are assigned the same alphanumeric references and will not be described anew.

According to this variant embodiment, the variable constriction means E of the throat of the venturi 11 consists of a cylindrical rod 30 mounted so as to be able to slide in an inclined direction from upstream to downstream on the geometric axis of the venturi 11. The inclination is approximately 50° in the example shown. The cylindrical rod 30 is mounted so as to be able to slide in a bore 31 of the body of the venturi which opens at the throat. That end 32 of the rod which is oriented toward the throat of the venturi is essentially hemispherical. The rod 30 comprises a longitudinal, preferably axial, duct 33 which opens toward the throat of the venturi at the end 32 and which is connected, at its other end, to a radial line 34 which opens into the chamber 17 located on the side of the membrane 18 oriented toward the venturi. The rod 30 is connected to the membrane 18 which delimits, on the side opposite to the chamber 17, the other chamber 29 connected to the throat of the second venturi 27 via the duct 28.

The pressure at the throat of the venturi 11 is transmitted to the chamber 17 via the longitudinal duct 30 and the transverse line 34.

The metering device of FIGS. 7-11 operates in a similar manner to that described with reference to the preceding figures. The cylindrical rod 30 with its hemispherical end makes it possible to reduce turbulence in the flow and to improve overall performance.

FIGS. 12 and 13 show an advantageous variant embodiment of the metering device of FIGS. 7-11. Those elements which are identical to elements of FIGS. 7-11 are assigned the same alphanumeric references and will not be described anew.

According to this variant, the pressure tapping by means of which it is possible to measure the flow rate at the throat 11*c* of the venturi is provided by a duct 35 located upstream of the cylindrical vane or rod 30*a*, whose outer wall is continuous. The longitudinal duct of the embodiment of FIG. 7 is omitted.

The cylindrical vane 30*a*, with the hemispherical lower end 32*a*, is attached to the end of a rod 36, of smaller diameter than 30*a*. The membrane 18 is attached to the widened end of the rod 36, remote from the vane 30*a*.

The duct 35 brings into communication the region of the throat of the venturi 11 with the chamber 17 located beneath the membrane 18. The rod 36 passes through a plate 37 (FIG. 14) which closes the chamber on the side of the throat 11*c* of the venturi. A passage extending the duct 35 and opening into the chamber 17 passes through the plate 37.

Advantageously, the rod 36 is sealed by means of a sealing ring 38 at the point where it passes through the plate 37. The reaction speed of the vane 30*a* is improved by thus reducing the cross section exposed to the pressure which prevails at the throat of the venturi by arranging a seal on the smaller-diameter rod 36. The vane 30*a* slides in its recess with sufficient radial gap to allow the liquid to pass through; its front face 32*a* and its rear face are exposed to the same liquid pressure.

The control pressures on either side of the membrane 18 must balance out when the division ratio is reached and gives the equilibrium position of the membrane. This condition is satisfied if, ideally, the pressures and cross sections are the same and thus the forces are identical. For this state of equilibrium, it is desirable to minimize the introduction of the control vane or rod into the main flow to minimize the pressure drop.

In the cylindrical-rod version, the rod cross section exposed to the pressure is no longer negligible in front of the active section of the membrane. In addition, according to the variant shown in FIGS. 12-14:

the active section of the membrane is increased, the influence of the rod cross section exposed to a pressure at the throat is reduced by a smaller-diameter seal.

These conditions have shown, in testing, that reading the flow rate via the control pressures is better respected and that the system reacts faster by virtue of the reduction in the resistive force due to the pressure field acting on the control rod.

The invention is not limited to the embodiments described with reference to the drawings but it encompasses the possible variants of the variable constriction means of the throat of the venturi and of the means sensitive to the pressure drop in the pump. In particular, the constriction means could consist of a pivoting constriction flap provided in the throat of the venturi and controlled by the means sensitive to the pressure drop. The membrane 18 could be replaced by a movable piston in a cylindrical recess, defining the two chambers 17 and 29, the movement of the piston controlling those of the vane 14 or of the rod 30.

The shape of the venturi 11 can be adjusted so as to establish, in operation with the throat 11*c* completely open and at full flow, a pressure drop at the throat of 2.6 bar and to obtain a pressure drop of less than 1.5 bar for metering at 1%.

The invention claimed is:

1. A metering device for introducing a liquid additive into a stream of main liquid flow flowing in a pipe, the device comprising a reciprocating differential piston pump (3) for taking up the additive in a container and metering the additive, this pump comprising a first inlet (8) for receiving the main liquid flow that drives the pump, a second inlet (9) for taking up the additive and an outlet (10) for mixing the additive and the main liquid, the device comprising a first Venturi channel (11) arranged in the pipe, the pump (3) being connected in parallel with the first Venturi channel (11), the first inlet (8) of the pump being connected via a first line (12) to the inlet of the first Venturi channel while the outlet (10) of the pump is connected via a second line (13) to a throat (11*c*) of the first Venturi channel, wherein the device comprises:

a means for varying the constriction (E) of the throat (11*c*) of the first Venturi channel, and a means (G) sensitive to the pressure drop in the pump (3), which means is able to control the means for constricting (E) the throat of the first Venturi channel to reduce a passage cross section when the pressure drop in the pump increases, and to increase the passage cross section when the pressure drop in the pump decreases.

2. The device as claimed in claim 1, wherein the means (G) sensitive to the pressure drop in the pump consists of a means for comparing the pressure at the throat (11*c*) of the first Venturi channel (11) with the pressure at a throat of a second Venturi channel (27) arranged on the first line (12) leading to the first inlet (8) of the pump.

3. The device as claimed in claim 2, wherein the means for comparing the pressures at the throats of the first and second Venturi channels (11, 27) comprises a movable means for separating two chambers (17, 29) connected respectively to the throat of one of the first and second Venturi channels (11, 27), a constriction member being connected to this movable means for separating such that a pressure increase at the throat of the second Venturi channel (27) relative to the pressure at the throat of the first Venturi channel (11) causes an increase in the constriction of the throat of the first Venturi channel, and vice-versa.

4. The device as claimed in claim 3, wherein the movable means for separating comprises a membrane (18).

5. The device as claimed in claim 1, wherein the means for varying the constriction of the throat of the first Venturi channel comprises a sliding member (14, 30, 30*a*) which is mounted so as to be able to slide in a direction inclined with respect to a geometric axis of the first Venturi channel (11).

6. The device as claimed in claim 5, wherein the sliding member consists of a vane (14).

7. The device as claimed in claim 6, wherein the vane (14) is mounted so as to be able to slide, with sufficient gap (j), in a guide of a body of the first Venturi channel such that the pressure at the throat (11*c*) is transmitted to a chamber (17) located on a side of the throat (11*c*) of the first Venturi channel.

8. The device as claimed in claim 5, wherein the sliding member consists of a cylindrical rod (30, 30*a*).

9. The device as claimed in claim 8, wherein that end (32, 32*a*) of the cylindrical rod (30, 30*a*) which is oriented toward the throat is essentially hemispherical.

10. The device as claimed in claim 9, wherein the cylindrical rod (30*a*) is attached to the end of a smaller-diameter rod (36) which passes in a sealed manner through a plate (37) closing a chamber (17) connected to the throat of the first Venturi channel (11).

11. The device as claimed in claim 9, further comprising a duct (35) located upstream of the constriction member (30*a*) to provide a pressure tapping by means of which it is possible to measure a flow rate at the throat of the first Venturi channel.

12. The device as claimed in claim 9, the cylindrical rod comprises a longitudinal duct (33) which opens at the duct's end on a side of the throat of the first Venturi channel (11) and is connected, at the duct's other end, to a chamber (17) located on the side of the throat (11*c*) of the first Venturi channel.

13. The device as claimed in claim 8, wherein the cylindrical rod (30*a*) is attached to the end of a smaller-diameter rod (36) which passes in a sealed manner through a plate (37) closing a chamber (17) connected to the throat of the first Venturi channel (11).

14. The device as claimed in claim 13, further comprising a duct (35) located upstream of the constriction member (30*a*) to provide a pressure tapping by means of which it is possible to measure a flow rate at the throat of the first Venturi channel.

15. The device as claimed in claim 8, further comprising a duct (35) located upstream of the constriction member (30*a*) to provide a pressure tapping by means of which it is possible to measure a flow rate at the throat of the first Venturi channel.

16. The device as claimed in claim 8, wherein the cylindrical rod comprises a longitudinal duct (33) which opens at the duct's end on a side of the throat of the first Venturi channel (11) and is connected, at the duct's other end, to a chamber (17) located on the side of the throat (11*c*) of the first Venturi channel.

17. The device as claimed in claim 1, wherein the outlet line (13) of the pump is connected to the throat of the first Venturi channel via at least one opening (25) which is lateral with respect to the attachment of the line on a body of the first Venturi channel.

18. The device as claimed in claim 1, wherein the first Venturi channel (11) and the pump (3) form an assembly, such that the first Venturi channel can be inserted into and connected to two sections of the pipe (1).

19. The device as claimed in claim 1, the means for varying the constriction of the throat of the first Venturi channel comprises a member (14, 30, 30*a*) which is mounted so as to be able to slide in a direction inclined with respect to a geometric axis of the first Venturi channel (11).

* * * * *